United States Patent [19]

Lindholm et al.

[11] Patent Number: 4,961,601

[45] Date of Patent: Oct. 9, 1990

[54] VEHICLE CLOSURE LATCH AND POP-UP DEVICE

[75] Inventors: Kari A. Lindholm, Livonia; James Bolsworth, Sterling Heights, both of Mich.

[73] Assignee: General Motors Corporation, Detroit, Mich.

[21] Appl. No.: 237,024

[22] Filed: Aug. 29, 1988

[51] Int. Cl.[5] ..... E05C 3/26

[52] U.S. Cl. ..... 292/216; 292/DIG. 72; 292/DIG. 14; 292/48

[58] Field of Search ..... 292/216, 50, 48, 280, 292/DIG. 14, DIG. 43, DIG. 72

[56] References Cited

U.S. PATENT DOCUMENTS

| | | | |
|---|---|---|---|
| 2,333,465 | 11/1943 | Claud-Mantle | 292/DIG. 72 X |
| 2,797,116 | 6/1957 | Jaster | 292/29 |
| 3,397,906 | 8/1968 | Beckman et al. | 292/29 |
| 3,794,365 | 2/1974 | Richberg | 292/DIG. 72 X |
| 3,905,624 | 9/1975 | Fujita | 292/11 |
| 4,775,176 | 10/1988 | Ikeda | 292/216 |

*Primary Examiner*—Richard E. Moore

*Attorney, Agent, or Firm*—William A. Schuetz

[57] ABSTRACT

A compact vehicle hood latch and pop-up device can be pressembled as a unit and mounted to a vehicle and cooperate with a single striker on the hood to effect latching, pop-up and unlatching of the hood. It includes a pivotal primary latch, a detent lever cooperable with the primary latch, a pop-up lever extending across the path of the striker to effect movement of the latter to a pop-up position when the primary latch is released and a secondary latch to release the striker from its pop-up position.

6 Claims, 2 Drawing Sheets

FIG 1
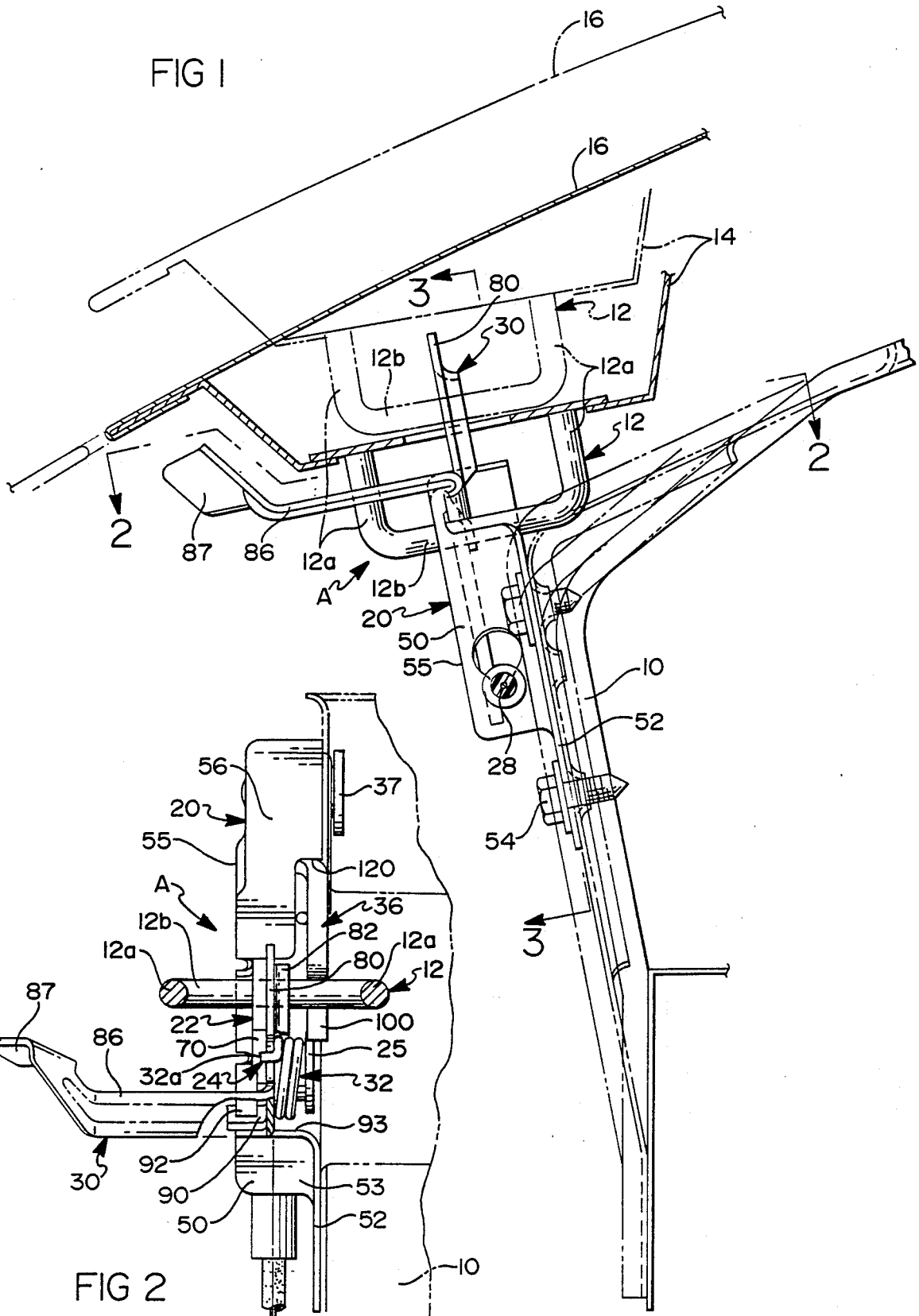
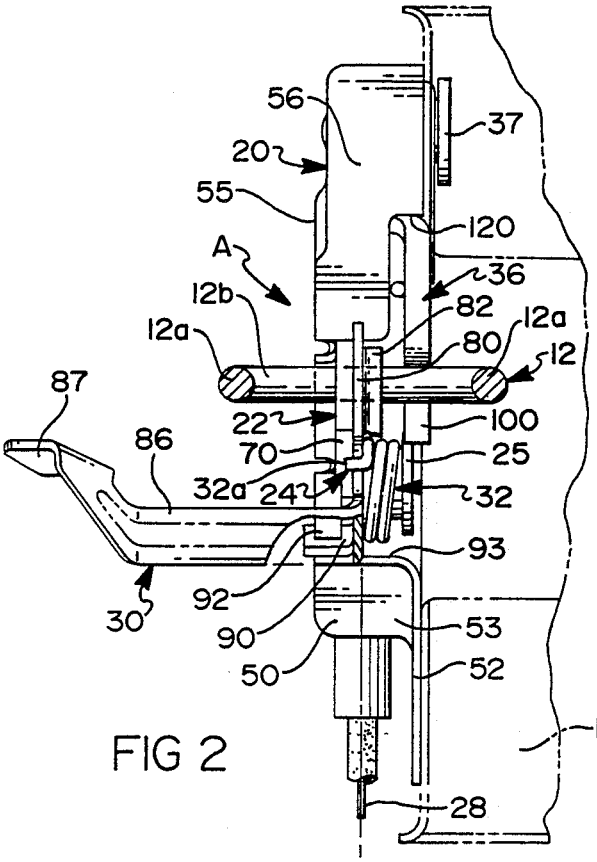
FIG 2

VEHICLE CLOSURE LATCH AND POP-UP DEVICE

The present invention relates to vehicle closure latch and pop-up devices and, more particularly, to a vehicle hood latch and pop-up device which can be preassembled and readily mounted as a unit on the vehicle and which is cooperably engageable with a single striker on the hood to effect latching, pop-up and unlatching of the hood.

An important object of the present invention is to provide a new and improved vehicle hood latch and pop-up mechanism or device which is of a relatively simple, compact, economical construction, uses only a minimum number of parts, and which can be preassembled in a single housing as a unit and then readily mounted to the vehicle and which is cooperably engageable with a single striker carried on the underside of the hood to both latch the hood in the closed position and to pop-up the hood to a pop-up position.

Another object of the present invention is to provide a new and improved vehicle hood latch and pop-up device, as defined in the next preceding object, and in which a detent lever for releasably holding or detenting a primary latch or latch lever is pivotally mounted on a pivot shaft which also serves to pivotally mount a secondary latch or latch lever and wherein both the detent lever and the secondary latch are spring biased towards their respective detent and latch positions by a single torsion spring surrounding the pivot shaft.

A further object of the present invention is to provide a new and improved vehicle hood latch and pop-up mechanism, as defined in the next preceding object, and which includes a spring biased pop-up lever pivotally mounted to the housing and disposed within the path of movement of the striker for moving the striker and hood to a pop-up position when the detent lever is moved to release the primary latch or latch lever.

These and other objects of the present invention are accomplished by providing a novel hood latch and pop-up device which comprises a single housing which is mountable to vehicle support structure, a primary latch pivotally supported by the housing via a first pivot means for movement between a latched position in which it is hookable over a striker pin to latch the pin in a closed position and an unlatched position in which it releases the striker to allow movement of the hood toward an open position, a detent lever pivotally supported by the housing via a second pivot means for movement between a detented position in which it cooperably engages the latch to hold the same in its latched position and a second position in which it is disengaged from the latch, a release means connected with the detent lever for effecting movement of the detent lever from its detented to its second position, a secondary latch pivotally supported by the second pivot means for movement between a latched position in which an end thereof is located above the primary latch and in the path of movement of the striker to limit the upward extent of movement of the striker to a pop-up position when the primary latch is unlatched and an unlatched position in which the end of the secondary latch is disposed out of the path of movement of the striker to enable the hood to be moved to a fully opened position, a single torsion spring means operatively connected with both the detent lever and the secondary latch for simultaneously biasing the detent lever towards its detented position and the secondary latch towards its latched position, a pop-up lever also pivotally supported by the housing by a third pivot means, and a second torsion spring means operatively connected with the pop-up lever and the housing for biasing the pop-up lever toward an upper position in which it is disposed within the path of movement of the striker and with the pop-up lever being movable from its upper position in opposition to the biasing force of the second spring means to a depressed position and held therein by the striker when the hood is in its closed position, the second spring means effecting upward movement of the pop-up lever to move the striker and the hood to a pop-up position in which the striker engages the secondary latch when the primary latch is moved to its unlatched position, the secondary latch being manually manipulable to enable the secondary latch to be moved to its unlatched position when the striker and the hood are in their pop-up position, and wherein the primary and secondary latches have striker surfaces thereon which are engageable by the striker to allow the secondary latch to be momentarily cammed to its unlatched position and the primary latch to be cammed to its latch position in response to movement of the hood towards its closed position.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in Which:

FIG. 1 is a side elevational view of the novel hood latch and pop-up device of the present invention and showing the same mounted to a front end structure of a vehicle and showing its relative position with a hood;

FIG. 2 is a cross sectional view taken approximately along the lines of 2—2 of FIG. 1;

Figure 3:
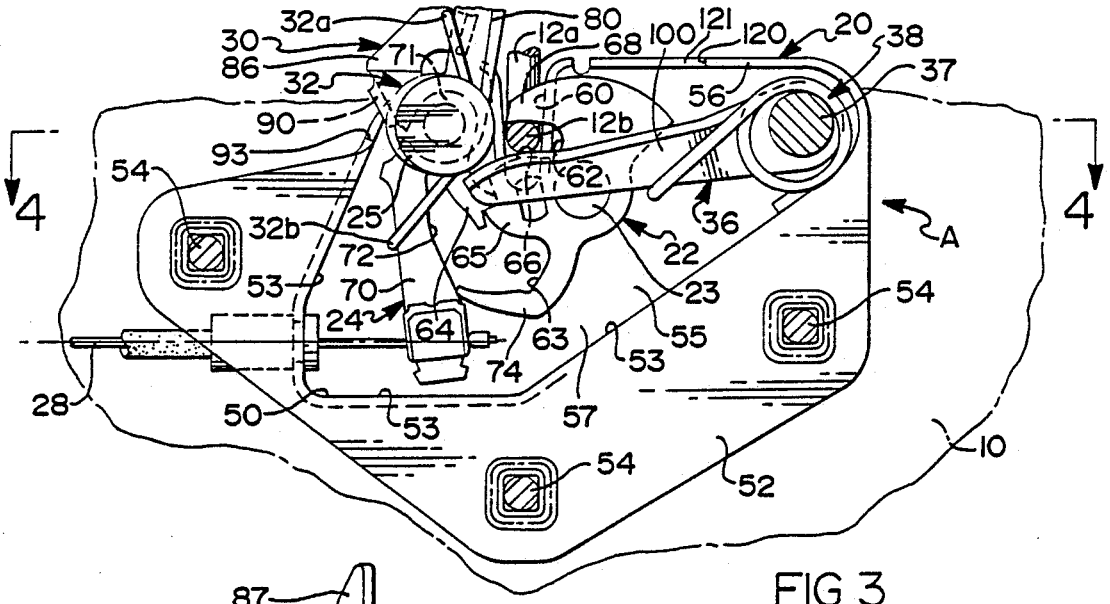
FIG. 3 is a cross-sectional view taken approximately along the lines 3—3 of FIG. 1.

The present invention provides a novel hood latch and pop-up device or mechanism A. As best shown in FIG. 1, the novel hood latch and pop-up device A is adapted to be mounted to suitable or conventional body support structure 10 located at the front end of an automotive vehicle (not shown) and is adapted to be used in conjunction with a striker pin 12 suitably welded or otherwise cured to an underside support panel 14, which in turn is secured to an underside of a vehicle hood 16. The striker 12 is preferably in the form of a U-shaped pin having a pair of vertically extending legs **12*a* and a generally horizontally disposed bight 12*b*. The striker pin 12** is circular in cross section.

The hood 16 is adapted to be suitably swingably or pivotally mounted to other body structure (not shown) of the vehicle and is movable between a closed position, as shown by the solid lines in FIG. 1, a pop-up position, as shown by the phantom lines in FIG. 1 and an open position (not shown) in which access to an engine compartment underneath the hood can be had.

The novel hood latch and pop-up device A functions to automatically latch the hood 16 in its closed position when the latter is moved thereto, can be operated to first release the hood 16 for movement from its closed position to a pop-up position, as shown by the phantom lines in FIG. 1, and then can be manually manipulated to release the hood for movement from its pop-up position to its fully open position (not shown). The hood 16 can be moved from its fully open position back to its closed position without requiring any manual manipulation of the hood latch and pop-up device A and with the latter automatically functioning to latch the same in its closed position.

Figure 5:
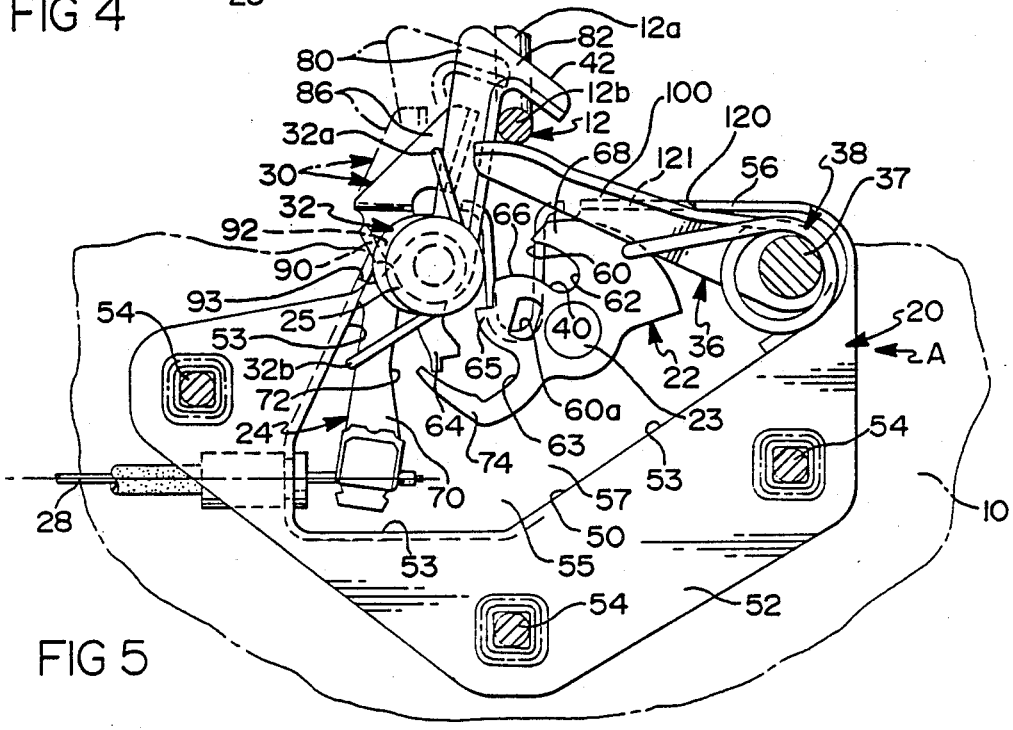
FIG. 5 is a view like that shown in FIG. 3, but showing parts thereof in different positions.

The novel hood latch and pop-up device A comprises, in general, a housing 20 which is mounted to the vehicle support structure 10, a primary latch 22 pivotally supported by the housing via a first pivot means 23 for movement between a latched position, as shown in FIG. 3, in which it is hookable over the striker pin 12 to latch the closure in a closed position and an unlatched position, as shown in FIG. 5, in which it unlatches the striker to allow movement of the hood 16 toward an open position, a detent lever 4 pivotally supported by the housing via a second pivot means 25 for movement between a detented position, as shown in FIG. 3, in which it cooperably engages the primary latch 22 to hold the same in its latched position and a second position, as shown in FIG. 5, in which it is disengaged from the primary latch 22 to allow the primary latch to move to its unlatched position, a release means 28 connected with the detent lever 24 for effecting movement of the detent lever 24 from its detented position to its second position, a secondary latch 30 pivotally supported by the second pivot means 25 for movement between a latched position, as shown by the solid lines in FIGS. 3 and 5, in which an end thereof is located above the primary latch 22 and in the path of movement of the striker 12 to limit the extent of upward movement of the striker 12 after the detent lever 24 releases the primary latch 22 for movement to its unlatched position and an unlatched position, as shown by the phantom lines in FIG. 5, in which the end of the secondary latch 30 is disposed out of the path of movement of the striker 12 to enable the hood 16 to be moved to its fully open position, a first spring means operatively connected with both the detent lever 24 and the secondary latch 30 for simultaneously biasing the detent lever 24 towards its detented position and the secondary latch 30 towards its latched position, a pop-up lever 36 pivotally supported by the housing 20 by a third pivot means 37, a second spring means operatively connected with the pop-up lever 36 and the housing 20 for biasing the pop-up lever 36 toward an upper position, as shown in FIG. 5, in which it is disposed within the path of movement of the striker 12, the pop-up lever 36 being movable from its upper position in opposition to the biasing force of the second spring means 38 to a depressed position, as shown in FIG. 3, and held therein by the striker 12 when the hood 16 is in its closed position. The secondary latch 30 is manually manipulable to enable the secondary latch 30 to be moved towards its unlatched position, as shown by the phantom lines in FIG. 5, when the striker 12 and the hood 16 are in their pop-up position and the primary and secondary latches 22 and 30, respectively, having striker surfaces 40 and 42 thereon which are engageable by the striker 12 to allow the secondary latch 30 to be momentarily cammed to its unlatched position and the primary latch position to be cammed to its latched position when the hood 16 is moved to its closed position.

The housing 20 is a single, stamped, sheet metal member and comprises a cup-shaped portion 50 and a planar flanged portion 52 integral with three sides 53 of the cup shaped portion 50. The planar flange portion 52 is adapted to abuttingly engage the support structure 10 at the front end of the vehicle (as shown in FIGS. 1 and 3) and be suitably secured to the support structure 10 by three screws 54. The cup shaped portion 50 has a bottom wall 55, the three sides 3, and a peripherally extending side wall 56 of a lesser width along its top side. The bottom 55 and side walls 53 and 56 define a recess 57 which is open on its side opposite the bottom wall 55, i.e., which is open on its side adjacent the flange portion 52. The open recess 57 and the housing 20 enables the various components to be assembled thereto and the flange portion 52 enables the housing 20 to abuttingly engage the support structure 10 and be secured thereto. As best shown in FIG. 5, the top side wall 56 of the housing 20 is provided with a vertical slot 60 having a rounded bottom **60*a* which is adapted to receive the bight 12*b* of the striker pin 12**.

The primary latch lever 22 for latching the striker 12 and the hood 16 in its closed position comprises a relatively thick, stamped, steel member which is suitably pivotally connected to the bottom wall 55 of the housing 20 by the pivot pin means 23. The latch or latch lever 22 adjacent its upper end, as viewed in FIG. 3, has a curved, or arcuate slot 62 therein for receiving the bight portion **12*b* of the striker 12 and adjacent its lower end has a slot 63 which is adapted to receive one leg 64 of the detent lever 24. The latch lever 22 intermediate its upper and lower ends includes a stepped boss portion 65. The boss portion 65 at its upper side defining one side of the slot and a striker surface 66. The boss portion 65 has a lower surface which defines one side of the slot 63. The latch lever 22 includes a hook portion 68 which defines the upper side of the slot 62 and which is adapted to overlie the bight 12*b* of the striker 12. The latch 22 is weighted or unbalanced so that if free from all external constraints, it will be self-biased by gravity toward a position in which the hooked end 68 is disengaged from the striker, which position is shown in FIG. 5. In this position, the striker surface 66 will be located adjacent the slot 60 in the housing 20 and be located in the path of movement of the striker 12**.

The detent lever 24, which is pivotally connected to the pivot means 25 secured to the bottom 55 of the housing 20. The detent lever besides the lever 64 includes a leg 70 and an intermediate boss portion 71, the latter portion being pivotally connected to the bottom 55 of the housing 20 by the pivot means 25. The legs 64 and 70 are spaced from one another to define a slot 72 therebetween to receive a leg 74 on the latch levers 22 and which defines the lower side of the slot 63 and the latch lever 22. The leg 70 of the detent lever 24 at its end remote from the pivot 25 is suitably connected to one end of a cable release means 28.

The cable release means 28 comprises a suitable bowden cable which extends through a ferrule 80 secured to the side wall 56 of the housing 20. The cable release 28 at its end remote from the detent lever 24 would be suitably connected to a manually manipulable handle or pivot located on the dashboard of the vehicle and which would be operated by the operator of the vehicle if he desired to release the hood from its closed position.

The secondary latch lever 30 is also pivotally secured to the pivoting means 25 at a location intermediate its opposite ends. The latch lever 30 includes an upwardly extending latch portion 80 having a hooked end 82. The latch levers 30 also has a handle portion 86 extending laterally of the upwardly extending portion 80 and which extends towards the front of the vehicle, as best shown in FIG. 1. The handle portion at its end has a manually graspable or manipulable end 87 which can be manipulated to rotate the secondary latch 30 about its pivot axis 25.

Figure 4:
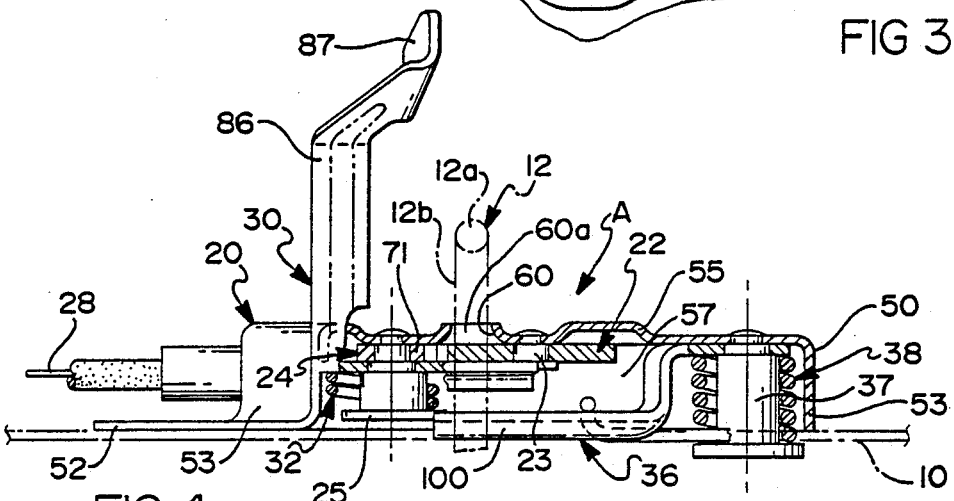
FIG. 4 is a cross-sectional view taken approximately along the lines 4—4 of FIG. 3.

The secondary latch or latch lever 30 is supported by the pivot means 25 for movement between a latched position, as shown by the solid lines in FIGS. 3–5, in which the end portion 80 thereof is vertically disposed so as to have its end portion 82 overlying the striker, the bight **12*b* of the striker pin 12 or which lies in the path of movement of the striker pin 12, and an unlatched position, as shown by the phantom lines in FIG. 5, in which the end 82 thereof is disposed out of the path of movement of the striker pin 12. The upper end 82 of the end portion 80 of the secondary latch 30 has an inclined striker surface 42 which is engageable by the striker pin 12 when the hood 16 is being moved toward a closed position so as to enable the latch 30 to be cammed or moved from its latched position, as shown by the solid lines in FIG. 5, to its unlatched position, as shown by the phantom lines in FIG. 5, to enable the hood 16** to be moved to its closed position.

In accordance with one of the features of the present invention, a single torsion spring 32 is provided for biasing both the secondary latch 30 towards its latched position and for biasing the detent lever 24 towards its detented position, as shown in FIG. 3. The torsion spring 32 surrounds the pivot means 25 and has one end **32*a* in engagement with the backside of the upwardly extending portion 80 of the latch member 30 and its other end 32*b* in engagement with the side of the leg 70 of the detent lever 24 remote from the pivot 23. The torsion spring 32 functions to bias the leg 64 of the detent lever into engagement with the boss 65 of the latch lever 22 and serves to bias the upper end portion 80 of the latch lever 30 towards its latch position. The lever 30 has a transversely extending ear 90 which is engageable with a stop surface 92 formed by an edge of an opening 93 in the leftmost side wall 53 of the housing 20, as best shown in FIG. 5. The stop 92 limits the pivotal movement of the latch lever 30 in a clockwise direction to position the same in its latched position. Counterclockwise pivotal movement of the detent lever 24, as viewed in FIGS. 3 and 5, is limited as a result of the leg 64 engaging the boss 65 on the latch lever 22**.

The pop-up lever 36 has a stepped shaped, as best shown in FIG. 4, and has one end thereof pivotally connected to the bottom 55 of the housing 20 by the pivot pin means 37. The pop-up lever 36 is elongated and has its other end 100 disposed across the path of movement of the striker pin 12. The pop-up lever 36 is biased in an upward direction by the torsion spring 38. The torsion spring surrounds the pivot shaft 37 and has one end in engagement with the underside of the end portion 100 of the lever 36 and its other end in engagement with the side wall 56 of the housing.

The pop-up lever 36 is movable between a raised position, as shown in FIG. 5, and a depressed position, as shown in FIG. 3. When the hood 16 is in its closed position and the striker pin 12 is received in the slot 60 in the housing 20, the striker pin engages the upper side of the pop-up lever 36 and moves the same to its depressed position, in opposition to the biasing force of the torsion spring 38, as shown in FIG. 3. In this position, the torsion spring 38 is exerting its maximum biasing force against a pop-up lever 36 in an upward moving direction. When the primary latch lever 22 is released or moved to its unlatched position, the pop-up lever 36 will move the striker pin 12 upwardly to its pop-up position, as shown in FIG. 5, due to the biasing force of the torsion spring 38. The upward movement of the pop-up lever is limited by a stop 120 formed by a side surface defining an opening 121 in the top side wall 56 of the housing, as shown in FIG. 5.

Operation of the novel hood latch and pop-up devices will now be described. When the hood 16 is in its closed position, as shown by the solid lines in FIG. 1, striker pin 12 is received within the slot 60 in the housing 20 and is disposed within the slot 62 in the primary latch lever 22. That is, as best shown in FIG. 3, the upper hooked end portion 68 of the primary latch lever overlies the striker pin 12 to hold the same and to hold the hood 16 in its closed position. Also, when the hood is in its closed position, the pop-up lever 36 is in its depressed position, as shown in FIG. 3, in which it is disposed beneath the striker pin 12. Likewise, the secondary lever 30 is located in its latched position in which the hooked end 82 overlies the path of movement of the striker 12. In addition, in this position, the stepped leg 64 of the detent lever 24 is in engagement with the stepped boss portion 65 of the latch lever 22 to hold the same in its latched position.

If the operator desires to open the hood, he will merely pull on the release cable 28 from the passenger compartment of the vehicle. When the release cable 28 is pulled toward the left, as viewed in FIG. 3, the detent lever 24 is rotated in a clockwise direction about the pivot means 25. Rotation of the detent lever 24 in a clockwise direction causes the stepped leg 64 to release from the stepped boss portion 65 of the latch lever 22. When the latch lever 22 is released from the detent leg 64 of the detent lever 24, the upward force of the pop-up lever 36 due to the torsion spring 38 biasing the same upwardly in conjunction with the weighted latch lever 22 tending to move the same in a clockwise direction (in addition to any upward force exerted on the hood by the usual rubber bumpers engageable by the hood when it is moved in its closed position), will cause the latch lever 22 to move in a clockwise direction so that the hooked end 68 will release the bight **12*b* of the striker 12. As the pop-up lever 36 moves the striker 12 upwardly until it engages the stop 120 on the top side wall 56 of the housing 20, the striker 12 will engage the upper portion 80 of the secondary latch 30. However, since the secondary latch 30 still has its hooked end 82 overlying the path of movement of the striker, the striker cannot move any further than into upward engagement with the inner side of the hooked end 82. This is the pop-up position of the hood 16, which is shown in FIG. 5 and shown by the phantom lines in FIG. 1**.

The operator can then move to the front of the vehicle and manually reach under the hood to engage the end 87 of the handle 80 of the secondary latch 30. By pulling on the handle and rotating the secondary latch 30 from the latched position, as shown by the solid lines in FIG. 5 to the unlatched position, as shown by the phantom lines in FIG. 5, the striker 12 can clear the secondary latch to allow the hood 16 to be moved to its fully open position.

It should be noted that when the detent lever 24 is released by the operator releasing the release cable 28, that the torsion spring 32 will return the detent lever 24 toward the latch lever 22 and with the leg 64 thereof engaging the boss portion 65 of the latch lever 22 below the step and with the leg 64 of the detent lever 24 being received within the slot 63, which prevents the latch lever 22 from accidentally being bumped or returned towards its latch position so as to prevent closure of the hood 16.

When the operator desires to close the hood 16, he will merely pull down on the hood 16. As the hood approaches its closed position, the bight **12*b* of the striker 12 will first engage the striker surface 42 of the secondary latch lever 30 and cam and pivot the latch lever 30 in a counterclockwise direction, as viewed in FIGS. 3 and 5, towards its unlatched position, as shown by the phantom lines in FIG. 5, until the bight 12*b* of the striker 12 passes the upper end 82 of the latch lever 30. The pivotal movement of the latch lever 30 is in opposition to the biasing force of the torsion spring 32 and when the striker 12 moves past the upper end 82, the torsion spring 32 will return the secondary latch 30 towards its latched position, as shown in FIGS. 3 and 5. As the striker pin 12 moves further downwardly, it will engage the pop-up lever 36 and move the same from its upper position, as shown in FIG. 5, towards its depressed position, as shown in FIG. 3. When the pop-up lever 36 is moved passed the side of the boss portion 65 defining the slot 60, the bight 12*b* of the striker 12 will engage the boss portion 65 at its striker surface 66. This will cause the latch lever 22 to be rotated in a counterclockwise direction and with the hooked end portion 68 hooking over the bight 12 of the striker pin 12 to latch the hood in its closed position. At the same time, rotation of the boss portion 65 of the latch 22 in the counterclockwise direction, causes the stepped portion thereof to come and register with the stepped detent leg 64 of the lever 24 and with the stepped detent leg being received into the stepped portion of the boss 65 on the latch lever 22 due to the biasing force of the torsion spring. This now causes the latch lever 22** to be latched in its latched position and prevent rotation thereof in a clockwise direction.

From the foregoing, it should be readily apparent that a novel latch and pop-up device for an automotive hood has been provided The novel latch and pop-up device is of a relatively simple and economical construction, is all made from stamped metal parts and can be preassembled as a unit within a stamped metal housing having a relatively small transverse dimension, as shown in FIG. 4. In addition, the hood latch devices uses a minimum number of springs and a minimum number of parts. In addition to using a single torsion spring means for biasing a secondary latch lever and a detent lever towards its latched and detented position, the novel pop-up device also mounts the pop-up lever on the same housing as the primary and secondary latches Although the illustrated embodiment thereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. In an automotive vehicle having body structure defining a vehicle compartment, a closure having a striker on its underside and which is supported by said body structure for movement between a closed position in which it covers said compartment and an open position in which it permits access to said compartment, and a preassembled closure latch and pop-up device which is mounted as a unit to the vehicle body structure and which cooperably engages the striker on said closure to releasably hold the latter in a closed position, said closure latch and pop up device comprising a housing which is mounted to the vehicle support structure, a primary latch pivotally supported by the housing via a first pivot means for movement between a latched position in which it is hookable over the striker pin to latch the closure in a closed position and an unlatched position in which it unlatches the striker to allow movement of the closure to an open position, said primary latch being biased towards its unlatched position, a detent lever pivotally supported by said housing via a second pivot means for movement between a detented position in which it cooperably engages said primary latch to hold the same in its latched position and a second position in which it is disengaged from said primary latch to allow said primary latch to move toward its unlatched position, release means connected with said detent lever for effecting movement of the detent lever from its detented to its second position, a secondary latch pivotally supported by said second pivot means for movement between a latched position in which an end thereof is located above the primary latch and in the path of movement of the striker to limit the extent of upward movement of the striker after the detent lever releases the primary latch for movement to its unlatched position to unlatch the striker, and an unlatched position in which said end of said secondary latch is disposed out of the path of movement of the striker to enable the closure to be moved toward its fully open position, a single first spring means operatively connected with both the detent lever and said secondary latch for simultaneously biasing the detent lever toward its detented position and said secondary latch toward its latched position, a pop-up lever pivotally supported by said housing by a third pivot means, a second spring means operatively connected with said pop up lever and said housing for biasing said pop up lever to an upper position in which it is disposed within the path of movement of said striker, said pop up lever being movable from its upper position and in opposition to the biasing force of said second spring means to a depressed position and held therein by the striker when the closure is in its closed position, said second spring means effecting upward movement of said pop up lever to move said striker and closure to a pop up position in which the striker engages said secondary latch when the primary latch is moved to its unlatched position by said release means, said secondary latch being manually manipulable to enable the secondary latch to be moved to its unlatched position when the striker and closure are in their pop up position, said primary and secondary latches having striker surfaces thereon which are engageable by the striker to allow the secondary latch to be momentarily cammed to its unlatched position and the primary latch to be cammed to its latched position when the closure is moved toward its closed position.

2. In an automotive vehicle having body structure defining a vehicle engine compartment, a hood having a striker on its underside and with the hood being supported by said body structure for movement between a closed position in which it covers said compartment and an open position in which it permits access to said compartment, and a preassembled hood latch and pop-up device which is mounted as a unit to the vehicle body structure and which cooperably engages the striker on said hood to releasably hold the latter in a closed position, said hood latch and pop up device comprising a housing which is mounted to the vehicle support structure, a primary latch pivotally supported by the housing via a first pivot means for movement between a latched position in which it is hookable over the striker to latch the hood in a closed position and an unlatched position in which it unlatches the strike to allow movement of the hood to an open position, said primary latch being biased towards its unlatched position, a detent lever pivotally supported by said housing via a second pivot means for movement between a detented position in which it cooperably engages said primary latch to hold the same in its latched position and a second position in which it is disengaged from said primary latch to allow said primary latch to move toward its unlatched position, release means connected with said detent lever for effecting movement of the detent lever from its detented to its second position, a secondary latch pivotally supported by said second pivot means for movement between a latched position in which an end thereof is located above the primary latch and in the path of movement of the striker to limit the extent of upward movement of the striker after the detent lever releases the primary latch for movement to its unlatched position to unlatch the striker, and an unlatched position in which said end of said secondary latch is disposed out of the path of movement of the striker to enable the closure to be moved toward its fully open position, a single, first spring means operatively connected with both the detent lever and said secondary latch for simultaneously biasing the detent lever toward its detented position and said secondary latch toward its latched position, a pop-up lever pivotally supported by said housing via a third pivot means, a second spring means operatively connected with said pop up lever and said housing for biasing said pop up lever to an upper position in which it is disposed within the path of movement of said striker, said pop up lever being movable from its upper position and in opposition to the biasing force of said second spring means to a depressed position and held therein by the striker when the hood is in its closed position, said second spring means effecting upward movement of said pop up lever to move said striker and hood to a pop up position in which the striker engages said secondary latch when the primary latch is moved to its unlatched position by said release means, said secondary latch being manually manipulable to enable the secondary latch to be moved to its unlatched position when the striker and hood are in their pop up position so that the hood can be moved to its fully open position, said primary and secondary latches having striker surfaces thereon which are engageable by the striker to allow the secondary latch to be momentarily cammed to its unlatched position and the primary latch to be cammed to its latched position when the hood is moved toward its closed position.

3. In an automotive vehicle having body structure defining a vehicle engine compartment, a hood having a striker on its underside and with the hood being supported by said body structure for movement between a closed position in which it covers said compartment and an open position in which it permits access to said compartment, and a preassembled hood latch and pop-up device which is mounted as a unit to the vehicle body structure and which cooperably engages the striker on said hood to releasably hold the latter in a closed position, said hood latch and pop up device comprising a housing which is mounted to the vehicle support structure, a primary latch pivotally supported by the housing via a first pivot means for movement between a latched position in which it is hookable over the striker to latch the hood in a closed position and an unlatched position in which it unlatches the striker to allow movement of the hood to an open position, said primary latch being biased towards its unlatched position, a detent lever pivotally supported by said housing via a second pivot means for movement between a detented position in which it cooperably engages said primary latch to hold the same in its latched position and a second position in which it is disengaged from said primary latch to allow said primary latch to move toward its unlatched position, manually operable release means connected with said detent lever for effecting movement of the detent lever from its detented to its second position, a secondary latch pivotally supported by said second pivot means for movement between a latched position in which an end thereof is located above the primary latch and in the path of movement of the striker to limit the extent of upward movement of the striker after the detent lever releases the primary latch for movement to its unlatched position to unlatch the striker, and an unlatched position in which said end of said secondary latch is disposed out of the path of movement of the striker to enable the closure to be moved toward its fully open position, a single, first spring means comprising a torsion spring surrounding said second pivot means and operatively connected with both the detent lever and said secondary latch for simultaneously biasing the detent lever toward its detented position and said secondary latch toward its latched position, a pop-up lever pivotally supported by said housing via a third pivot means and extending across the path of movement of said striker, a second spring means comprising a torsion spring surrounding said third pivot means and operatively connected with said pop up lever and said housing for biasing said pop up lever to an upper position in which it is disposed within the path of movement of said striker, said pop up lever being movable from its upper position and in opposition to the biasing force of said second spring means to a depressed position and held therein by the striker when the hood is in its closed position, said second spring means effecting upward movement of said pop up lever to move said striker and hood to a pop up position in which the striker engages said secondary latch when the primary latch is moved to its unlatched position by said release means, said secondary latch being manually manipulable to enable the secondary latch to be moved to its unlatched position when the striker and hood are in their pop up position so that the hood can be moved to its fully open position, said primary and secondary latches having striker surfaces thereon which are engageable by the striker to allow the secondary latch to be momentarily cammed to its unlatched position and the primary latch to be cammed to its latched position when the hood is moved toward its closed position, said first, second and third pivot means having their axes extending parallel to each other and said primary latch, secondary latch, detent lever, pop-up lever and housing being made from stamped sheet metal whereby said latching and pop-up device when preassembled as a unit has a relatively thin transverse overall dimension.

4. In an automotive vehicle, as defined in claim 3, and wherein said housing has a guide slot for receiving said striker.

5. In an automotive vehicle, as defined in claim 4, and wherein said striker comprises an inverted U-shaped pin.

6. In an automotive vehicle, as defined in claim 5, and wherein said housing has stop surfaces engageable by said pop-up lever and said secondary latch to limit upward movement of the pop-up lever and movement of the secondary latch past its latched position.

* * * * *